US011081266B2

(12) United States Patent
Hosono et al.

(10) Patent No.: US 11,081,266 B2
(45) Date of Patent: Aug. 3, 2021

(54) SOFT MAGNETIC ALLOY POWDER, DUST CORE, AND MAGNETIC COMPONENT

(71) Applicant: TDK CORPORATION, Tokyo (JP)

(72) Inventors: Masakazu Hosono, Tokyo (JP); Hiroyuki Matsumoto, Tokyo (JP); Kenji Horino, Tokyo (JP); Kazuhiro Yoshidome, Tokyo (JP); Isao Nakahata, Tokyo (JP); Akito Hasegawa, Tokyo (JP); Hajime Amano, Tokyo (JP)

(73) Assignee: TDK CORPORATION, Tokyo (JP)

( * ) Notice: Subject to any disclaimer, the term of this patent is extended or adjusted under 35 U.S.C. 154(b) by 339 days.

(21) Appl. No.: 16/296,559

(22) Filed: Mar. 8, 2019

(65) Prior Publication Data

US 2019/0279796 A1 Sep. 12, 2019

(30) Foreign Application Priority Data

Mar. 9, 2018 (JP) ..... JP2018-043652

(51) Int. Cl.
*H01F 3/00* (2006.01)
*H01F 1/153* (2006.01)
(Continued)

(52) U.S. Cl.
CPC ..... *H01F 1/153* (2013.01); *H01F 1/14766* (2013.01); *H01F 1/15308* (2013.01);
(Continued)

(58) Field of Classification Search
CPC ..... H01F 1/147; H01F 1/153; H01F 1/15333; H01F 1/15308; H01F 1/15383;
(Continued)

(56) References Cited

U.S. PATENT DOCUMENTS

2007/0235109 A1* 10/2007 Maeda ..... H01F 1/24 148/307
2010/0097171 A1* 4/2010 Urata ..... C21D 8/1211 336/233

(Continued)

FOREIGN PATENT DOCUMENTS

JP 3342767 B2 11/2002
JP 2012-012699 A 1/2012

(Continued)

*Primary Examiner* — Shawki S Ismail
*Assistant Examiner* — Lisa N Homza
(74) *Attorney, Agent, or Firm* — Oliff PLC

(57) ABSTRACT

Soft magnetic alloy powder includes plurality of soft magnetic alloy particles of soft magnetic alloy represented by composition formula $(Fe_{(1-(\alpha+\beta))}X1_{\alpha}X2_{\beta})_{(1-(a+b+c++e+f+g))}M_aB_bP_cSi_dC_eS_fTi_g$, wherein X1 represents Co and/or Ni; X2 represents at least one selected from group consisting of Al, Mn, Ag, Zn, Sn, As, Sb, Cu, Cr, Bi, N, O, and rare earth elements; M represents at least one selected from group consisting of Nb, Hf, Zr, Ta, Mo, W, and V; $0.020 \le a \le 0.14$, $0.020 < b \le 0.20$, $0 < c \le 0.15$, $0 \le d \le 0.060$, $0 \le e \le 0.040$, $0 \le f \le 0.010$, $0 \le g \le 0.0010$, $\alpha \ge 0$, $\beta \ge 0$, and $0 \le \alpha+\beta \le 0.50$ are satisfied, wherein at least one of f and g is more than 0; and wherein soft magnetic alloy has a nano-heterostructure with initial fine crystals present in an amorphous substance; and surface of each of the soft magnetic alloy particles is covered with a coating portion including a compound of at least one element selected from group consisting of P, Si, Bi, and Zn.

8 Claims, 2 Drawing Sheets

(51) Int. Cl.

| | |
|---|---|
| ***H01F 1/147*** | (2006.01) |
| ***H01F 27/24*** | (2006.01) |
| ***H01F 1/33*** | (2006.01) |
| ***H01F 3/08*** | (2006.01) |
| *H01F 1/26* | (2006.01) |
| *H01F 1/24* | (2006.01) |
| *H01F 41/02* | (2006.01) |

(52) U.S. Cl.
CPC ..... *H01F 1/15333* (2013.01); *H01F 1/33* (2013.01); *H01F 3/08* (2013.01); *H01F 27/24* (2013.01); *H01F 1/24* (2013.01); *H01F 1/26* (2013.01); *H01F 41/0246* (2013.01)

(58) Field of Classification Search
CPC ..... H01F 1/33; H01F 1/1475; H01F 1/14766; H01F 1/24; H01F 1/26; H01F 3/08; H01F 27/24; H01F 27/255; H01F 41/0246; H01F 17/04; C22C 38/001; C22C 38/002; C22C 38/005; C22C 38/007; C22C 38/008; C22C 38/02; C22C 38/04; C22C 38/06; C22C 38/07; C22C 38/08; C22C 38/18; C22C 38/16; C22C 38/10; C22C 38/12; C22C 38/01; C22C 2200/02; C22C 2200/04; B22F 1/02
USPC ..... 335/297; 428/570; 148/304
See application file for complete search history.

(56) References Cited

U.S. PATENT DOCUMENTS

| | | | | |
|---|---|---|---|---|
| 2010/0193726 | A1* | 8/2010 | Maeda | C09C 1/62 252/62.54 |
| 2010/0255188 | A1 | 10/2010 | Maeda et al. | |
| 2011/0085931 | A1 | 4/2011 | Ohta et al. | |
| 2016/0276074 | A1* | 9/2016 | Lee | H01F 1/24 |
| 2017/0006117 | A1 | 1/2017 | Kafle et al. | |
| 2018/0122540 | A1 | 5/2018 | Matsumoto et al. | |
| 2018/0218810 | A1 | 8/2018 | Harada et al. | |
| 2018/0218811 | A1 | 8/2018 | Harada et al. | |
| 2019/0221341 | A1* | 7/2019 | Yoshidome | C22C 38/00 |
| 2019/0221342 | A1* | 7/2019 | Yoshidome | H01F 1/15308 |
| 2019/0237229 | A1* | 8/2019 | Yoshidome | C22C 45/04 |
| 2019/0279796 | A1* | 9/2019 | Hosono | H01F 1/153 |
| 2019/0279799 | A1* | 9/2019 | Hosono | H01F 1/15383 |
| 2019/0355498 | A1* | 11/2019 | Yoshidome | C22C 38/007 |

FOREIGN PATENT DOCUMENTS

| | | | |
|---|---|---|---|
| JP | 2015-132010 | A | 7/2015 |
| JP | 2017-050390 | A | 3/2017 |
| JP | 6245390 | B1 | 12/2017 |
| JP | 6245391 | B1 | 12/2017 |
| JP | 2018-070966 | A | 5/2018 |
| KR | 10-2007-0030846 | A | 3/2007 |

* cited by examiner

SOFT MAGNETIC ALLOY POWDER, DUST CORE, AND MAGNETIC COMPONENT

BACKGROUND OF THE INVENTION

Field of the Invention

The present invention relates to a soft magnetic alloy powder, a dust core, and a magnetic component.

Description of the Related Art

As magnetic ingredients for use in a power circuit of various types of electronic equipment, a transformer, a choke coil, an inductor, and the like are known.

Such a magnetic component has a structure including a coil (winding) of electrical conductor disposed around or inside a magnetic core having predetermined magnetic properties.

It is required for the magnetic core of a magnetic component such as inductor to achieve high performance and miniaturization. Examples of the soft magnetic material excellent in magnetic properties for use as the magnetic core include an iron(Fe)-based nanocrystalline alloy. The nanocrystalline alloy is an alloy produced by heat-treating an amorphous alloy, such that nano-meter order fine crystals are deposited in an amorphous substance. For example, in Japanese Patent No. 3342767, a ribbon of soft magnetic Fe—B-M (M=Ti, Zr, Hf, V, Nb, Ta, Mo, W)-based amorphous alloy is described. According to Japanese Patent No. 3342767, the soft magnetic amorphous alloy has a higher saturation magnetic flux density compared with commercially available Fe amorphous alloys.

In production of a magnetic core as dust core, however, such a soft magnetic alloy in a powder form needs to be subjected to compression molding. In order to improve the magnetic properties of such a dust core, the proportion of magnetic ingredients (filling ratio) is enhanced. However, due to the low insulation of the soft magnetic alloy, in the case where particles of a soft magnetic alloy are in contact with each other, a loss caused by the current flowing between the particles (inter-particle eddy current) increases when a voltage is applied to a magnetic component. As a result, the core loss of a dust core increases, which has been a problem.

In order to suppress the eddy current, an insulation coating film is, therefore, formed on the surface of soft magnetic alloy particles. For example, Japanese Patent Laid-Open No. 2015-132010 discloses a method for forming an insulating coating layer, in which a powder glass containing oxides of phosphorus (P) softened by mechanical friction is adhered to the surface of an Fe-based amorphous alloy powder.

In Japanese Patent Laid-Open No. 2015-132010, an Fe-based amorphous alloy powder having an insulating coating layer is mixed with a resin to make a dust core through compression molding. Although the withstand voltage of a dust core improves with increase of the thickness of the insulating coating layer, the packing ratio of magnetic ingredients decreases, so that magnetic properties deteriorate. In order to obtain excellent magnetic properties, the withstand voltage of the dust core, therefore, needs to be improved through enhancement of the insulating properties of the soft magnetic alloy powder having an insulating coating layer as a whole.

Under these circumstances, an object of the present invention is to provide a dust core having excellent withstand voltage, a magnetic component having the same, and a soft magnetic alloy powder suitable for use in the dust core.

SUMMARY OF THE INVENTION

The present inventors have found that providing soft magnetic alloy particles of a soft magnetic alloy having a specific composition with a coating portion improves the insulation of the entire powder containing the soft magnetic alloy particles, so that the withstand voltage of a dust core improves. Based on the founding, the present invention has been accomplished.

In other words, the present invention in an aspect relates to the following:

[1] A soft magnetic alloy powder including a plurality of soft magnetic alloy particles of a soft magnetic alloy represented by a composition formula $(Fe_{(1-(\alpha+\beta))}X1_{\alpha}X2_{\beta})_{(1-(a+b+c++e+f+g))}M_aB_bP_cSi_dC_eS_fTi_g$, wherein X1 represents at least one selected from the group consisting of Co, and Ni;

X2 represents at least one selected from the group consisting of Al, Mn, Ag, Zn, Sn, As, Sb, Cu, Cr, Bi, N, O, and rare earth elements;

M represents at least one selected from the group consisting of Nb, Hf, Zr, Ta, Mo, W, and V;

a, b, c, d, e, f, g, α, and β satisfy the following relations:

$0.020 \leq a \leq 0.14$, $0.020 < b \leq 0.20$, $0 < c \leq 0.15$, $0 \leq d \leq 0.060$, $0 \leq e \leq 0.040$, $0 \leq f \leq 0.010$, $0 \leq g \leq 0.0010$, $\alpha \geq 0$, $\beta \geq 0$, and $0 \leq \alpha+\beta \leq 0.50$, wherein at least one of f and g is more than 0; and wherein the soft magnetic alloy has a nano-heterostructure with initial fine crystals present in an amorphous substance;

the surface of each of the soft magnetic alloy particles is covered with a coating portion; and the coating portion includes a compound of at least one element selected from the group consisting of P, Si, Bi, and Zn.

[2] The soft magnetic alloy powder according to item [1], wherein the initial fine crystal has an average grain size of 0.3 nm or more and 10 nm or less.

[3] A soft magnetic alloy powder including a plurality of soft magnetic alloy particles of a soft magnetic alloy represented by a composition formula $(Fe_{(1-(\alpha+\beta))}X1_{\alpha}X2_{\beta})_{(1-(a+b+c++e+f+g))}M_aB_bP_cSi_dC_cS_fTi_g$, wherein X1 represents at least one selected from the group consisting of Co, and Ni;

X2 represents at least one selected from the group consisting of Al, Mn, Ag, Zn, Sn, As, Sb, Cu, Cr, Bi, N, O, and rare earth elements;

M represents at least one selected from the group consisting of Nb, Hf, Zr, Ta, Mo, W, and V;

a, b, c, d, e, f, g, α, and β satisfy the following relations:

$0.020 \leq a \leq 0.14$, $0.020 < b \leq 0.20$, $0 < c \leq 0.15$, $0 \leq d \leq 0.060$, $0 \leq e \leq 0.040$, $0 \leq f \leq 0.010$, $0 \leq g \leq 0.0010$, $\alpha \geq 0$, $\beta \geq 0$, and $0 \leq \alpha+\beta \leq 0.50$, wherein at least one of f and g is more than 0; and wherein the soft magnetic alloy has an Fe-based nanocrystal;

the surface of each of the soft magnetic alloy particles is covered with a coating portion; and the coating portion includes a compound of at least one element selected from the group consisting of P, Si, Bi, and Zn.

[4] The soft magnetic alloy powder according to item [3], wherein the Fe-based nanocrystal has an average grain size of 5 nm or more and 30 nm or less.

[5] A dust core including the soft magnetic alloy powder according to any one of items [1] to [4].

[6] A magnetic component including the dust core according to item [5].

According to the present invention, a dust core having excellent withstand voltage, a magnetic component having the same, and a soft magnetic alloy powder suitable for use in the dust core can be provided.

DETAILED DESCRIPTION OF THE PREFERRED EMBODIMENT

Figure 1:
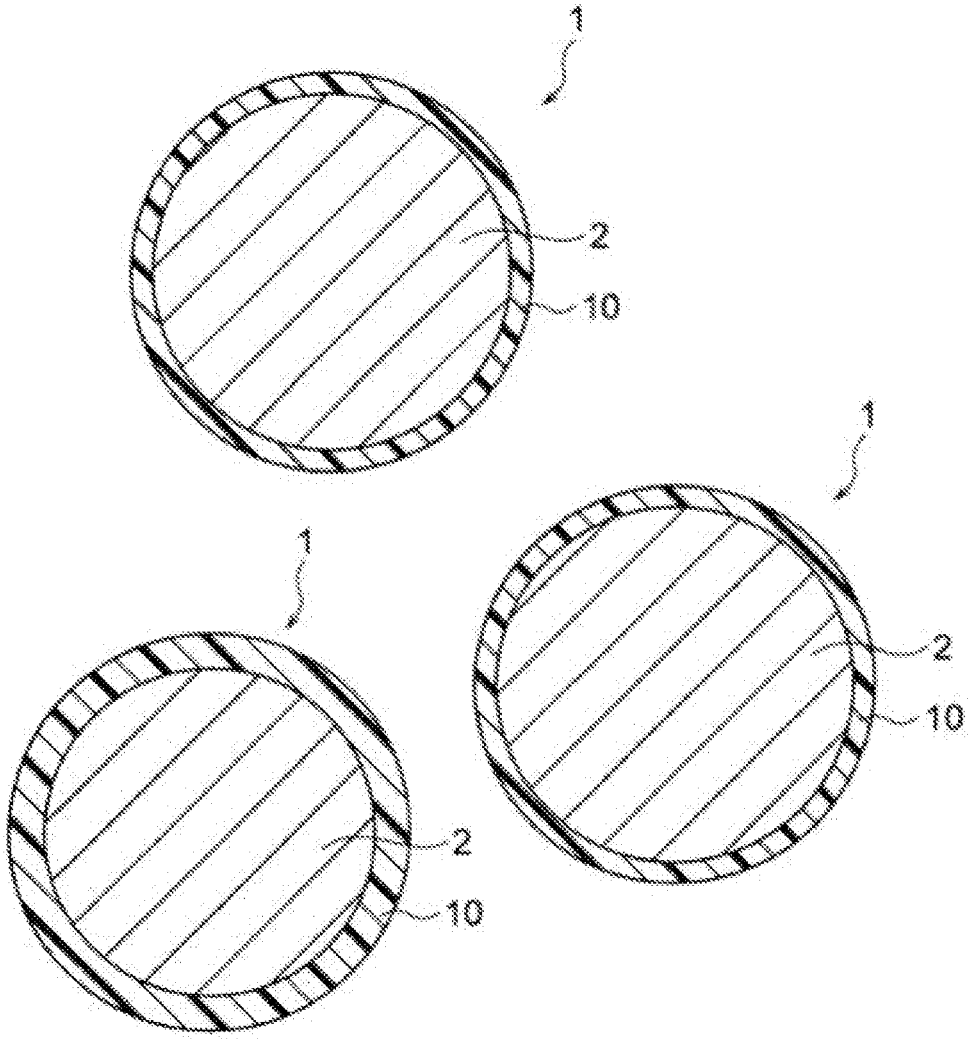
FIG. 1 is a cross-sectional schematic view of coated particles to constitute a soft magnetic alloy powder in the present embodiment.

With reference to specific embodiments shown in the drawings, the present invention is described in the following order.

1. Soft magnetic alloy powder
1.1. Soft magnetic alloy
1.1.1. First aspect
1.1.2. Second aspect
1.2. Coating portion
2. Dust core
3. Magnetic component
4. Method for producing dust core
4.1. Method for producing soft magnetic alloy powder
4.2. Method for producing dust core (1. Soft Magnetic Alloy Powder)

The soft magnetic alloy powder in the present embodiment includes a plurality of coated particles 1 having a coating portion 10 on the surface of soft magnetic alloy particles 2, as shown in FIG. 1. When the proportion of the number of particles contained in the soft magnetic alloy powder is set as 100%, the proportion of the number of coated particles is preferably 90% or more, more preferably 95% or more. The shape of the soft magnetic alloy particles 2 is not particularly limited, and usually in a spherical form.

The average particle size (D50) of the soft magnetic alloy powder in the present embodiment may be selected depending on the use and material. In the present embodiment, the average particle size (D50) is preferably in the range of 0.3 to 100 μm. With an average particle size of the soft magnetic alloy powder in the above-described range, sufficient formability or predetermined magnetic properties can be easily maintained. The method for measuring the average particle size is not particularly limited, and use of laser diffraction/scattering method is preferred.

In the present embodiment, the soft magnetic alloy powder may contain soft magnetic alloy particles of the same material only, or may be a mixture of soft magnetic alloy particles of different materials. Here, the difference in materials includes an occasion that the elements constituting the metal or the alloy are different, an occasion that even if the elements constituting the metal or the alloy are the same, the compositions are different, or the like.

(1.1. Soft Magnetic Alloy)

Soft magnetic alloy particles include a soft magnetic alloy having a specific structure and a composition. In the description of the present embodiment, the types of soft magnetic alloy are divided into a soft magnetic alloy in a first aspect and a soft magnetic alloy in a second aspect. The soft magnetic alloy in the first aspect and the soft magnetic alloy in the second aspect have difference in the structure, with the composition in common.

(1.1.1. First Aspect)

The soft magnetic alloy in the first aspect has a nano-heterostructure with initial fine crystals present in an amorphous substance. The structure includes a number of fine crystals deposited and dispersed in an amorphous alloy obtained by quenching a molten metal made of melted raw materials of the soft magnetic alloy. The average grain size of the initial fine crystals is, therefore, very small. In the present embodiment, the average grain size of the initial fine crystals is preferably 0.3 nm or more and 10 nm or less.

The soft magnetic alloy having such a nano-heterostructure is heat-treated under predetermined conditions to grow the initial fine crystals, so that a soft magnetic alloy in a second aspect described below (a soft magnetic alloy having Fe-based nanocrystals) can be easily obtained.

The composition of the soft magnetic alloy in the first aspect is described in detail as follows.

The soft magnetic alloy in the first aspect is a soft magnetic alloy represented by a composition formula $(Fe_{(1-(\alpha+\beta))}X1_{\alpha}X2_{\beta})_{(1-(a+b+c++e+f+g))}M_aB_bP_cSi_dC_eS_fTi_g$, in which a relatively high content of Fe is present.

In the composition formula, M represents at least one element selected from the group consisting of Nb, Hf, Zr, Ta, Mo, W and V.

Further, "a" represents the amount of M, satisfying a relation $0.020 \leq a \leq 0.14$. The amount of M ("a") is preferably 0.040 or more, more preferably 0.050 or more. Also, the amount of M ("a") is preferably 0.10 or less, more preferably 0.080 or less.

When "a" is too small, a crystal phase including crystals having a grain size more than 30 nm tends to be formed in the soft magnetic alloy before heat treatment. The occurrence of the crystal phase allows no Fe-based nanocrystals to be deposited by heat treatment. As a result, the coercivity of the soft magnetic alloy tends to increase. On the other hand, when "a" is too large, the saturation magnetization of the powder tends to decrease.

In the composition formula, "b" represents the amount of B (boron), satisfying a relation $0.020 < b \leq 0.20$. The amount of B ("b") is preferably 0.025 or more, more preferably 0.060 or more, further preferably 0.080 or more. Also, the amount of B ("b") is preferably 0.15 or less, more preferably 0.12 or less.

When "b" is too small, a crystal phase including crystals having a grain size more than 30 nm tends to be formed in the soft magnetic alloy before heat treatment. The occurrence of the crystal phase allows no Fe-based nanocrystals to be deposited by heat treatment. As a result, the coercivity of the soft magnetic alloy tends to increase. On the other hand, when "b" is too large, the saturation magnetization of the powder tends to decrease.

In the composition formula, "c" represents the amount of P (phosphorus), satisfying a relation $0<c\leq0.15$. The amount of P ("c") is preferably 0.005 or more, more preferably 0.010 or more. Also, the amount of P ("c") is preferably 0.100 or less.

When "c" is in the above range, the resistivity of the soft magnetic alloy tends to improve and the coercivity tends to decrease. When "c" is too small, the above effects tend to be hardly obtained. On the other hand, when "c" is too large, the saturation magnetization of the powder tends to decrease.

In the composition formula, "d" represents the amount of Si (silicon), satisfying a relation $0\leq d\leq0.060$. In other words, the soft magnetic alloy may contain no Si. The amount of Si ("d") is preferably 0.001 or more, more preferably 0.005 or more. Also, the amount of Si ("d") is preferably 0.040 or less.

When "d" is in the above range, the coercivity of the soft magnetic alloy tends to decrease. On the other hand, when "d" is too large, the coercivity of the soft magnetic alloy tends to increase.

In the composition formula, "e" represents the amount of C (carbon), satisfying a relation $0\leq e\leq0.040$. In other words, the soft magnetic alloy may contain no C. The amount of C ("e") is preferably 0.001 or more. Also, the amount of C ("e") is preferably 0.035 or less, more preferably 0.030 or less.

When "e" is in the above range, the coercivity of the soft magnetic alloy tends to particularly decrease. On the other hand, when "e" is too large, the coercivity of the soft magnetic alloy tends to increase.

In the composition formula, "f" represents the amount of S (sulfur), satisfying a relation $0\leq f\leq0.010$. The amount of S ("f") is preferably 0.002 or more. Also, the amount of S ("f") is preferably 0.010 or less.

When "f" is in the above range, the coercivity of the soft magnetic alloy tends to decrease. When "f" is too large, the coercivity of the soft magnetic alloy tends to increase.

In the composition formula, "g" represents the amount of Ti (titanium), satisfying a relation $0\leq g\leq0.0010$. The amount of Ti ("g") is preferably 0.0002 or more. Also, the amount of Ti ("g") is preferably 0.0010 or less.

When "g" is in the above range, the coercivity of the soft magnetic alloy tends to decrease. When "g" is too large, a crystal phase including crystals having a grain size more than 30 nm tends to be formed in the soft magnetic alloy before heat treatment. The occurrence of the crystal phase allows no Fe-based nanocrystals to be deposited by heat treatment. As a result, the coercivity of the soft magnetic alloy tends to increase.

In the present embodiment, it is important for the soft magnetic alloy to contain S and/or Ti, in particular. In other words, "f" and "g" are in the above ranges, and any one of "f" and "g", or both of "f" and "g", need to be more than 0. With "f" and "g" satisfying such relations, the sphericity of the soft magnetic alloy particles tends to improve. Through improvement of the sphericity of the soft magnetic alloy particles, the density of a dust core produced by compression molding of the powder including the soft magnetic alloy particles can be further improved. Containing S means that "f" is not 0. More specifically, it means a relation $f\geq0.001$. Containing Ti means that "g" is not 0. More specifically, it means a relation $g\geq0.0001$.

Without containing both of S and Ti, the sphericity of the soft magnetic alloy particles tend to reduce, so that the density of a dust core produced from the powder containing the soft magnetic alloy particles tends to decrease.

In the composition formula, $1-(a+b+c+d+e+f+g)$ represents an amount of Fe (iron). In the present embodiment, the amount of Fe, i.e., $1-(a+b+c+d+e+f+g)$, is preferably 0.73 or more and 0.95 or less, though not particularly limited. With an amount of Fe in the above range, the crystal phase including crystals having a grain size more than 30 nm tends to be further hardly formed.

Furthermore, a part of Fe in the soft magnetic alloy in the first aspect may be replaced with X1 and/or X2 in the composition as shown in the above composition formula.

X1 represents at least one element selected from the group consisting of Co and Ni. In the above composition formula, a represents the amount of X1, and is 0 or more in the present embodiment. In other words, the soft magnetic alloy may contain no X1.

When the number of atoms in the whole composition is set as 100 at %, the number of atoms of X1 is preferably 40 at % or less. In other words, the following expression is preferably satisfied: $0\leq\alpha\{1-(a+b+c+d+e+f+g)\}\leq0.40$.

X2 represents at least one element selected from the group consisting of Al, Mn, Ag, Zn, Sn, As, Sb, Cu, Cr, Bi, N, O and rare earth elements. In the above composition formula, $\beta$ represents the amount of X2, and is 0 or more in the present embodiment. In other words, the soft magnetic alloy may contain no X2.

When the number of atoms in the whole composition is set as 100 at %, the number of atoms of X2 is preferably 3.0 at % or less. In other words, the following expression is preferably satisfied: $0\leq\beta\{1-(a+b+c+d+e+f+g)\}50.030$.

Furthermore, the range of Fe amount replaced with X1 and/or X2 expressed in the number of atoms (amount replaced) is set to less than half the total number of Fe atoms. In other words, an expression $0\leq\alpha+\beta\leq0.50$ is satisfied. When a+p is too large, it tends to be difficult to produce a soft magnetic alloy having Fe-based nanocrystals deposited by heat treatment.

The soft magnetic alloy in a first aspect may contain elements other than described above as inevitable impurities. For example, the total amount of the elements other than the above may be 0.1 wt %/o or less with respect to 100 wt % of a soft magnetic alloy.

(1.1.2. Second Aspect)

The soft magnetic alloy in the second aspect is composed in the same manner as the soft magnetic alloy in the first aspect, except that the structure is different. Accordingly, redundant description is omitted in the following. In other words, the description on the composition of the soft magnetic alloy in the first aspect is also applied to the soft magnetic alloy in the second aspect.

The soft magnetic alloy in the second aspect includes an Fe-based nanocrystal. The Fe-based nanocrystal is a crystal of Fe having a bcc crystal structure (body-centered cubic lattice structure). In the soft magnetic alloy, a number of Fe-based nanocrystals are deposited and dispersed in an amorphous substance. In the present embodiment, the Fe-based nanocrystals can be suitably obtained by heat-treating powder including the soft magnetic alloy in the first aspect to grow initial fine crystals.

The average grain size of the Fe-based nanocrystals, therefore, tends to be slightly more than the average grain size of the initial fine crystals. In the present embodiment, the average grain size of the Fe-based nanocrystals is preferably 5 nm or more and 30 nm or less. A soft magnetic alloy in which Fe-based nanocrystals are present in a dispersed state in an amorphous substance tends to have high saturation magnetization and low coercivity.

(1.2. Coating portion)

A coating portion 10 is formed to cover the surface of a soft magnetic metal particle 2 as shown in FIG. 1. In the present embodiment, the surface covered with a material means a form of the material in contact with the surface, being fixed to cover the contacted parts. The coating portion to cover the soft magnetic alloy particle may cover at least a part of the surface of the particle, preferably the whole surface. Further, the coating portion may continuously cover the surface of a particle, or may cover the surface in fragments.

The configuration of the coating portion 10 is not particularly limited, so long as the soft magnetic alloy particles constituting the soft magnetic alloy powder can be insulated from each other. In the present embodiment, preferably the coating portion 10 contains a compound of at least one element selected from the group consisting of P, Si, Bi and Zn, particularly preferably a compound containing P. More preferably the compound is an oxide, particularly preferably an oxide glass. With a coating portion of the above configuration, the adhesion with elements segregated in the amorphous substance in a soft magnetic alloy (P, in particular) is improved, so that the insulating properties of the soft magnetic alloy powder are enhanced. As a result, the resistivity of the soft magnetic alloy powder improves, so that the withstand voltage of a dust core obtained by using the soft magnetic alloy powder can be enhanced. In the case where a soft magnetic alloy contains Si in addition to P contained in the soft magnetic alloy, the effect can be also suitably obtained.

Further, the compound of at least one element selected from the group consisting of P, Si, Bi and Zn is preferably contained as a main component in the coating portion 10. "Containing oxides of at least one element selected from the group consisting of P, Si, Bi and Zn as a main component" means that when the total amount of elements except for oxygen among elements contained in the coating portion 10 is set as 100 mass %, the total amount of at least one element selected from the group consisting of P, Si, Bi and Zn is the largest. In the present embodiment, the total amount of these elements is preferably 50 mass % or more, more preferably 60 mass % or more.

Examples of the oxide glass include a phosphate ($P_2O_5$) glass, a bismuthate ($Bi_2O_3$) glass, and a borosilicate ($B_2O_3$—$SiO_2$) glass, though not particularly limited thereto.

As the $P_2O_5$ glass, a glass including 50 Wt/% or more of $P_2O_5$ is preferred, and examples thereof include $P_2O_5$—ZnO—$R_2O$—$Al_2O_3$ glass, wherein "R" represents an alkali metal.

As the $Bi_2O_3$ glass, a glass including 50 wt % or more of $Bi_2O_3$ is preferred, and examples thereof include a $Bi_2O_3$—ZnO—$B_2O_3$—$SiO_2$ glass.

As the $B_2O_3$—$SiO_2$ glass, a glass including 10 wt % or more of $B_2O_3$ and 10 wt % or more of $SiO_2$ is preferred, and examples thereof include a BaO—ZnO—$B_2O_3$—$SiO_2$—$Al_2O_3$ glass.

Due to having such an insulating coating portion, the particle has further enhanced insulating properties, so that the withstand voltage of a dust core including soft magnetic alloy powder containing the coated particles is improved.

The components contained in the coating portion can be identified by EDS elemental analysis using TEM such as STEM, EELS elemental analysis, lattice constant data obtained by FFT analysis of a TEM image, and the like.

The thickness of the coating portion 10 is not particularly limited, so long as the above effect is obtained. In the present embodiment, the thickness is preferably 5 nm or more and 200 nm or less. The thickness is preferably 150 nm or less, more preferably 50 nm or less.

(2. Dust Core)

The dust core in the present embodiment is not particularly limited, so long as the dust core including the soft magnetic alloy powder described above is formed into a predetermined shape. In the present embodiment, the dust core includes the soft magnetic alloy powder and a resin as binder, such that the soft magnetic alloy particles to constitute the soft magnetic alloy powder are bonded to each other through the resin to be fixed into a predetermined shape. In addition, the dust core may include a powder mixture of the soft magnetic alloy powder described above and another magnetic powder to be formed into a predetermined shape.

(3. Magnetic Component)

The magnetic component in the present embodiment is not particularly limited, so long as the dust core described above is included therein. For example, the magnetic component may include a wire-winding air-core coil embedded in a dust core in a predetermined shape, or may include a wire with a predetermined winding number wound on the surface of a dust core with a predetermined shape. The magnetic component in the present embodiment is suitable as a power inductor for use in a power circuit, due to excellent withstand voltage.

(4. Method for Producing Dust Core) A method for producing a dust core for use in the magnetic component is described as follows. First, a method for producing a soft magnetic alloy powder to constitute the dust core is described.

(4.1. Method for Producing Soft Magnetic Alloy Powder)

The soft magnetic alloy powder in the present invention can be obtained by using the same method as a known method for producing a soft magnetic alloy powder. Specifically, the powder can be produced by using a gas atomization method, a water atomization method, a rotating disc method, etc. Alternatively, a ribbon produced by a single roll process or the like may be mechanically pulverized to produce the powder. In particular, use of gas atomization method is preferred from the perspective that a soft magnetic alloy powder having desired magnetic properties is easily obtained.

In the gas atomization method, first, the raw materials of a soft magnetic alloy to constitute the soft magnetic alloy powder are melted to make a molten metal. The raw materials (pure metals or the like) of each metal element contained in the soft magnetic alloy are prepared, weighed so as to achieve the composition of the finally obtained soft magnetic alloy, and melted. The method for melting the raw material of metal elements is not particularly limited, and examples thereof include a melting method by high frequency heating in the chamber of an atomization apparatus after vacuum drawing. The temperature during melting may be determined in consideration of the melting points of each metal element, and, for example, may be 1200 to 1500° C.

The obtained molten metal is supplied to the chamber through a nozzle disposed at the bottom of a crucible, in a linear continuous form. A high-pressure gas is blown into the supplied molten metal, such that the molten metal is formed into droplets and quenched to make fine powder. The gas blowing temperature, the pressure in the chamber and the like may be determined according to conditions allowing Fe-based nanocrystals to be easily deposited in an amorphous substance by the heat treatment described below.

Since the soft magnetic alloy contains S and/or Ti, the molten metal is easily divided by gas blowing on this occasion, so that the sphericity of the particles to constitute the obtained power can be improved. The particle size can be controlled by sieve classification, stream classification or the like.

It is preferable that the obtained powder be made of soft magnetic alloy having a nano-heterostructure with initial fine crystals in an amorphous substance, i.e., the soft magnetic alloy in the first aspect, so that Fe-based nanocrystals are easily deposited by the heat treatment described below. The obtained powder, however, may be made of amorphous alloy with each metal element uniformly dispersed in an amorphous substance, so long as Fe-based nanocrystals are deposited by the heat treatment described below.

In the present embodiment, with presence of crystals having a grain size more than 30 nm in the soft magnetic alloy before heat treatment, crystal phases are determined to be present, while with absence of crystals having a grain size more than 30 nm, the alloy is determined to be amorphous. The presence or absence of crystals having a grain size more than 30 nm in a soft magnetic alloy may be determined by a known method. Examples of the method include X-ray diffraction measurement and observation with a transmission electron microscope. In the case of using a transmission electron microscope (TEM), the determination can be made based on a selected-area diffraction image or a nanobeam diffraction image obtained therefrom. In the case of using a selected-area diffraction image or a nanobeam diffraction image, a ring-shaped diffraction pattern is formed when the alloy is amorphous, while diffraction spots resulting from a crystal structure are formed when the alloy is non-amorphous.

The observation method for determining the presence of initial fine crystals and the average grain size is not particularly limited, and the determination may be made by a known method. For example, the bright field image or the high-resolution image of a specimen flaked by ion milling is obtained by using a transmission electron microscope (TEM) for the determination. Specifically, the presence or absence of initial fine crystals and the average grain size can be determined based on visual observation of a bright field image or a high-resolution image obtained with a magnification of $1.00\times10^5$ to $3.00\times10^5$.

Subsequently, the obtained powder is heat treated. The heat treatment prevents individual particles from being sintered to each other to be coarse particle, and accelerates the diffusion of elements to constitute the soft magnetic alloy, so that a thermodynamic equilibrium state can be achieved in a short time. The strain and the stress present in the soft magnetic alloy can be, therefore, removed. As a result, a powder including the soft magnetic alloy with Fe-based nanocrystals deposited, i.e., the soft magnetic alloy in the second aspect, can be easily obtained.

In the present embodiment, the heat treatment conditions are not particularly limited, so long as the conditions allow Fe-based nanocrystals to be easily deposited. For example, the heat treatment temperature may be set at 400 to 700° C., and the holding time may be set to 0.5 to 10 hours.

After the heat treatment, a powder containing the soft magnetic alloy particles with Fe-based nanocrystals deposited, i.e., the soft magnetic alloy in the second aspect, is obtained.

Subsequently, a coating portion is formed on the soft magnetic alloy particles contained in the heat-treated powder. The method for forming the coating portion is not particularly limited, and a known method can be employed. The soft magnet alloy particles may be subjected to a wet process or a dry process to form a coating portion.

Alternatively, a coating portion may be formed for the soft magnetic alloy powder before heat treatment. In other words, a coating portion may be formed on the soft magnetic alloy particles made of the soft magnetic alloy in the first aspect.

Figure 2:
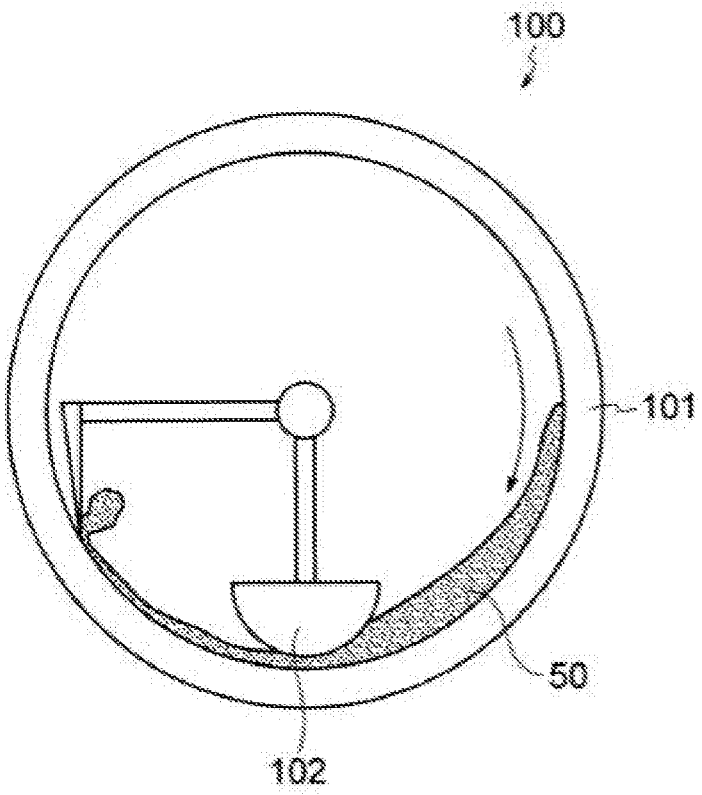
FIG. 2 is a cross-sectional schematic view showing the configuration of a powder coating device for use in forming a coating portion.

In the present embodiment, the coating portion can be formed by a mechanochemical coating method, a phosphate processing method, a sol gel method, etc. In the mechanochemical coating method, for example, a powder coating device 100 shown in FIG. 2 is used. A powder mixture of a soft magnetic alloy powder and a powder-like coating material to constitute the coating portion (a compound of P, Si, Bi, Zn, etc.) is fed into a container 101 of the powder coating device. After the feeding, the container 101 is rotated, so that a mixture 50 of the soft magnetic alloy powder and the powder-like coating material is compressed between a grinder 102 and the inner wall of the container 101 to cause friction, resulting in heat generation. Due to the generated friction heat, the powder-like coating material is softened and adhered to the surface of the soft magnetic alloy particles due to compression effect, so that a coating portion can be formed.

In the mechanochemical coating method, through adjustment of the rotation speed of the container, the distance between the grinder and the inner wall of the container and the like, the generated friction heat is controlled, so that the temperature of the mixture of the soft magnetic alloy powder and the powder-like coating material can be controlled. In the present embodiment, it is preferable that the temperature be 50° C. or more and 150° C. or less. Within the temperature range, the coating portion is easily formed to cover the surface of the soft magnetic alloy particles.

(4.2. Method for Producing Dust Core)

The dust core is produced by using the above soft magnetic alloy powder. The specific producing method is not particularly limited, and a known method may be employed. First, a soft magnetic alloy powder including the soft magnetic alloy particles with the coating portion and a known resin as a binder are mixed to obtain a mixture. The obtained mixture may be formed into a granulated powder as necessary. A mold is filled with the mixture or the granulated powder, which is then subjected to compression molding to produce a green compact having the shape of a dust core to be made. Due to the high sphericity of the soft magnetic alloy particles described above, the compression molding of the powder including the soft magnetic alloy particles allows the press mold to be densely filled with the soft magnetic alloy particles, so that a dust core having a high density can be obtained.

The obtained green compact is heat treated, for example, at 50 to 200° C., so that the resin is hardened and a dust core having a predetermined shape, with the soft magnetic alloy particles fixed through the resin, can be obtained. On the obtained dust core, a wire is wound with a predetermined number of turns, so that a magnetic component such as an inductor can be obtained.

Alternatively, a press mold may be filled with the mixture or the granulated powder described above and an air-core coil formed of a wire wound with a predetermined number of turns, which is then subjected to compression molding to obtain a green compact with the coil embedded inside. The obtained green compact is heat-treated to make a dust core in a predetermined shape with the coil embedded. Having a coil embedded inside, the dust core functions as a magnetic component such as an inductor.

Although the embodiments of the present invention have been described above, the present invention is not limited to the embodiments described above, and may be modified in various aspects within the scope of the present invention.

EXAMPLES

The present invention is described in detail with reference to Examples as follows, though the present invention is not limited to these Examples.

Experimental Samples 1 to 69

First, raw material metals of the soft magnetic alloy were prepared. The raw material metals prepared were weighed so as to achieve each of the compositions shown in Table 1, and accommodated in a crucible disposed in an atomization apparatus. Subsequently, after the inside of the chamber was vacuum drawn, the crucible was heated by high-frequency induction using a work coil provided outside the crucible, so that the raw material metals in the crucible were melted and mixed to obtain a molten metal (melted metal) at 1250° C.

The obtained molten metal was supplied into the chamber through a nozzle disposed at the bottom of a crucible, in a linear continuous form. To the molten metal supplied, a gas was sprayed to produce a powder. The temperature of the gas blowing was controlled at 125° C., and the pressure inside the chamber was controlled at 1 hPa. The average particle size (D50) of the obtained powder was 20 μm.

The obtained powder was subjected to X-ray diffraction measurement to determine the presence or absence of crystals having a grain size more than 30 nm. With absence of crystals having a grain size more than 30 nm, it was determined that the soft magnetic alloy to constitute the powder is composed of an amorphous phase, while with the presence of crystals having a grain size more than 30 nm, it was determined that the soft magnetic alloy is composed of a crystal phase. The results are shown in Table 1.

Subsequently, the obtained powder was heat-treated. In the heat treatment, the heat treatment temperature was controlled at 600° C., for a holding time of 1 hour. After the heat treatment, the powder was subjected to X-ray diffraction measurement and observation with TEM, so that the presence or absence of Fe-based nanocrystals was determined. The results are shown in Table 1. It was confirmed that in all the samples in Examples with presence of Fe-based nanocrystals, the Fe-based nanocrystals have a bce crystal structure, and an average grain size of 5 to 30 nm.

The powder after the heat treatment was subjected to the measurement of coercivity (Hc) and saturation magnetization (as). In the measurement of coercivity (Hc), 20 mg of the powder and paraffin were placed in a plastic case with a diameter of 6 mm and a height of 5 mm, and the paraffin was melted and solidified to fix the powder. The measurement was performed by using a coercivity meter (K-HC1000) produced by Tohoku Steel Co., Ltd. The magnetic field intensity for the measurement was set to 150 kA/m. In the present Examples, samples having a coercivity of 350 A/m or less were evaluated as good. The results are shown in Table 1. The saturation magnetization was measured with a vibrating-sample magnetometer (VSM) produced by Tamakawa Co., Ltd. In the present Examples, the samples having a saturation magnetization of 150 $A \cdot m^2/kg$ or more are evaluated as good. The results are shown in Table 1.

Subsequently, the powder after the heat treatment and a powder glass (coating material) were fed into the container of a powder coating device, so that the surface of the particles was coated with the powdery glass to form a coating portion. As a result, a soft magnetic alloy powder was produced. The amount of the powder glass added is set to 0.5 wt % relative to 100 wt % of the powder after the heat treatment. The thickness of the coating portion was 50 nm.

The powder glass was a phosphate glass having a composition of $P_2O_5$—ZnO—$R_2O$—$Al_2O_3$. Specifically, the composition consists of 50 wt % of $P_2O_5$, 12 wt % of ZnO, 20 wt % of $R_2O$, 6 wt % of $Al_2O_3$, and the remaining part being accessory components.

The present inventors made similar experiments using a glass having a composition consisting of 60 wt % of $P_2O_5$, 20 wt % of ZnO, 10 wt % of $R_2O$, 5 wt % of $Al_2O_3$, and the remaining part being accessory components, and confirmed that the same results described below were obtained.

Subsequently, the soft magnetic alloy powder with a coating portion formed was solidified to evaluate the resistivity of the powder. In the measurement of the resistivity of the powder, a pressure of 0.6 $t/cm^2$ was applied to the powder using a powder resistivity measurement system. In the present Examples, samples having a resistivity of $10^6$ Ωcm or more were evaluated as "excellent", samples having a resistivity of $10^5$ Ωcm or more were evaluated as "good", samples having a resistivity of $10^4$ Ωcm or more were evaluated as "fair", samples having a resistivity less than $10^4$ Ωcm were evaluated as "bad". The results are shown in Table 1.

Subsequently, a dust core was made. A total amount of an epoxy resin which is a thermosetting resin and an imide resin which is a hardening agent is weighed so as to be 3 wt % with respect to 100 wt % of the obtained soft magnetic alloy powder, the epoxy resin and the imide resin are added to acetone to be made into a solution, and the solution is mixed with the soft magnetic alloy powder. After the mixing, granules obtained by volatilizing the acetone are sized with a mesh of 355 μm. The granules are filled into a press mold with a toroidal shape having an outer diameter of 11 mm and an inner diameter of 6.5 mm and are pressurized under a molding pressure of 3.0 $t/cm^2$ to obtain the molded body of the dust core. The resins in the obtained molded body of the dust core are hardened under the condition of 180° C. and 1 hour, and the dust core is obtained. The density of the obtained dust core was measured by the following method.

The density calculated from the measurement of the outer diameter, the inner diameter, the height and the weight of the dust core was divided by the theoretical density calculated from the composition ratio of the soft magnetic alloy to obtain the relative density. The results are shown in Table 1.

A source meter is used to apply voltage on the top and the bottom of the samples of the dust core, and a voltage value when an electric current of 1 mA flows divided by the distance between the electrodes was defined as the withstand voltage. In the present Examples, samples having a withstand voltage of 100 V/mm or more were evaluated as good. The results are shown in Table 1.

TABLE 1

| | | Soft magnetic alloy powder | | | | | | | | | | | | | | |
|---|---|---|---|---|---|---|---|---|---|---|---|---|---|---|---|---|
| | | | | | | | | | | Powder properties | | | | Properties after coating | Dust core | |
| | Comparative | $(Fe_{(1-(a+b+c+d+e+f+g))}M_aB_bP_cSi_dC_eS_fTi_g)$ | | | | | | | | | | Coercivity | Saturation magnetization | Resistivity | Relative | Withstand |
| Experiment No. | Example/ Example | Fe | Nb a | B b | P c | Si d | C e | S f | Ti g | XRD | Fe-based nanocrystal | Hc (A/m) | σs (A · m²/kg) | ρ (Ω · cm) | density (%) | voltage (V/mm) |
| 1 | Example | 0.7944 | 0.060 | 0.090 | 0.050 | 0.000 | 0.000 | 0.005 | 0.0006 | Amorphous phase | Present | 177 | 171 | ○ | 64 | 515 |
| 2 | Comparative Example | 0.8394 | 0.015 | 0.090 | 0.050 | 0.000 | 0.000 | 0.005 | 0.0006 | Crystal phase | Absent | 33200 | 163 | Δ | 63 | 369 |
| 3 | Example | 0.8344 | 0.020 | 0.090 | 0.050 | 0.000 | 0.000 | 0.005 | 0.0006 | Amorphous phase | Present | 260 | 180 | ○ | 64 | 431 |
| 4 | Example | 0.8144 | 0.040 | 0.090 | 0.050 | 0.000 | 0.000 | 0.005 | 0.0006 | Amorphous phase | Present | 211 | 178 | ○ | 64 | 458 |
| 5 | Example | 0.8044 | 0.050 | 0.090 | 0.050 | 0.000 | 0.000 | 0.005 | 0.0006 | Amorphous phase | Present | 178 | 174 | ○ | 63 | 501 |
| 1 | Example | 0.7944 | 0.060 | 0.090 | 0.050 | 0.000 | 0.000 | 0.005 | 0.0006 | Amorphous phase | Present | 177 | 171 | ○ | 64 | 515 |
| 6 | Example | 0.7744 | 0.080 | 0.090 | 0.050 | 0.000 | 0.000 | 0.005 | 0.0006 | Amorphous phase | Present | 167 | 166 | ○ | 64 | 533 |
| 7 | Example | 0.7544 | 0.100 | 0.090 | 0.050 | 0.000 | 0.000 | 0.005 | 0.0006 | Amorphous phase | Present | 201 | 162 | ○ | 65 | 535 |
| 8 | Example | 0.7344 | 0.120 | 0.090 | 0.050 | 0.000 | 0.000 | 0.005 | 0.0006 | Amorphous phase | Present | 252 | 158 | ○ | 64 | 539 |
| 9 | Example | 0.7144 | 0.140 | 0.090 | 0.050 | 0.000 | 0.000 | 0.005 | 0.0006 | Amorphous phase | Present | 261 | 151 | ○ | 65 | 543 |
| 10 | Comparative Example | 0.7044 | 0.150 | 0.090 | 0.050 | 0.000 | 0.000 | 0.005 | 0.0006 | Amorphous phase | Present | 278 | 137 | ○ | 64 | 560 |
| 11 | Comparative Example | 0.8644 | 0.060 | 0.020 | 0.050 | 0.000 | 0.000 | 0.005 | 0.0006 | Crystal phase | Absent | 20171 | 185 | Δ | 64 | 382 |
| 12 | Example | 0.8594 | 0.060 | 0.025 | 0.050 | 0.000 | 0.000 | 0.005 | 0.0006 | Amorphous phase | Present | 245 | 187 | ○ | 64 | 411 |
| 13 | Example | 0.8244 | 0.060 | 0.060 | 0.050 | 0.000 | 0.000 | 0.005 | 0.0006 | Amorphous phase | Present | 211 | 180 | ○ | 65 | 447 |
| 14 | Example | 0.8044 | 0.060 | 0.080 | 0.050 | 0.000 | 0.000 | 0.005 | 0.0006 | Amorphous phase | Present | 168 | 175 | ○ | 63 | 488 |
| 1 | Example | 0.7944 | 0.060 | 0.090 | 0.050 | 0.000 | 0.000 | 0.005 | 0.0006 | Amorphous phase | Present | 177 | 171 | ○ | 64 | 515 |
| 15 | Example | 0.7644 | 0.060 | 0.120 | 0.050 | 0.000 | 0.000 | 0.005 | 0.0006 | Amorphous phase | Present | 192 | 167 | ○ | 65 | 521 |
| 16 | Example | 0.7344 | 0.060 | 0.150 | 0.050 | 0.000 | 0.000 | 0.005 | 0.0006 | Amorphous phase | Present | 228 | 160 | ○ | 65 | 528 |
| 17 | Example | 0.6844 | 0.060 | 0.200 | 0.050 | 0.000 | 0.000 | 0.005 | 0.0006 | Amorphous phase | Present | 245 | 154 | ○ | 64 | 537 |
| 18 | Comparative Example | 0.6744 | 0.060 | 0.210 | 0.050 | 0.000 | 0.000 | 0.005 | 0.0006 | Amorphous phase | Present | 262 | 135 | ○ | 65 | 542 |

TABLE 1-continued

| | | Soft magnetic alloy powder | | | | | | | | | | Powder properties | | Properties after coating | Dust core | |
|---|---|---|---|---|---|---|---|---|---|---|---|---|---|---|---|---|
| | Comparative | $(Fe_{(1-(a+b+c+d+e+f+g))}M_aB_bP_cSi_dC_eS_fTi_g)$ | | | | | | | | | | Coercivity | Saturation magnetization | Resistivity | Relative | Withstand |
| Experiment No. | Example/ Example | Fe | Nb a | B b | P c | Si d | C e | S f | Ti g | XRD | Fe-based nanocrystal | Hc (A/m) | σs (A · m²/kg) | ρ (Ω · cm) | density (%) | voltage (V/mm) |
| 19 | Comparative Example | 0.8444 | 0.060 | 0.090 | 0.000 | 0.000 | 0.000 | 0.005 | 0.0006 | Amorphous phase | Present | 363 | 181 | Δ | 64 | 385 |
| 20 | Example | 0.8434 | 0.060 | 0.090 | 0.001 | 0.000 | 0.000 | 0.005 | 0.0006 | Amorphous phase | Present | 329 | 180 | ○ | 64 | 402 |
| 21 | Example | 0.8394 | 0.060 | 0.090 | 0.005 | 0.000 | 0.000 | 0.005 | 0.0006 | Amorphous phase | Present | 321 | 180 | ○ | 65 | 430 |
| 22 | Example | 0.8344 | 0.060 | 0.090 | 0.010 | 0.000 | 0.000 | 0.005 | 0.0006 | Amorphous phase | Present | 312 | 179 | ○ | 64 | 448 |
| 23 | Example | 0.8144 | 0.060 | 0.090 | 0.030 | 0.000 | 0.000 | 0.005 | 0.0006 | Amorphous phase | Present | 295 | 175 | ○ | 64 | 488 |
| 1 | Example | 0.7944 | 0.060 | 0.090 | 0.050 | 0.000 | 0.000 | 0.005 | 0.0006 | Amorphous phase | Present | 177 | 171 | ○ | 64 | 515 |
| 24 | Example | 0.7644 | 0.060 | 0.090 | 0.080 | 0.000 | 0.000 | 0.005 | 0.0006 | Amorphous phase | Present | 212 | 161 | ◎ | 83 | 561 |
| 25 | Example | 0.7444 | 0.060 | 0.090 | 0.100 | 0.000 | 0.000 | 0.005 | 0.0006 | Amorphous phase | Present | 228 | 154 | ◎ | 65 | 607 |
| 26 | Example | 0.6944 | 0.060 | 0.090 | 0.150 | 0.000 | 0.000 | 0.005 | 0.0006 | Amorphous phase | Present | 253 | 151 | ◎ | 65 | 662 |
| 27 | Comparative Example | 0.6844 | 0.060 | 0.090 | 0.160 | 0.000 | 0.000 | 0.005 | 0.0006 | Amorphous phase | Present | 269 | 139 | ◎ | 64 | 681 |
| 1 | Example | 0.7944 | 0.060 | 0.090 | 0.050 | 0.000 | 0.000 | 0.005 | 0.0006 | Amorphous phase | Present | 177 | 171 | ○ | 64 | 515 |
| 28 | Example | 0.7844 | 0.060 | 0.090 | 0.050 | 0.000 | 0.010 | 0.005 | 0.0006 | Amorphous phase | Present | 144 | 169 | ○ | 64 | 419 |
| 29 | Example | 0.7644 | 0.060 | 0.090 | 0.050 | 0.000 | 0.030 | 0.005 | 0.0006 | Amorphous phase | Present | 169 | 166 | ○ | 64 | 351 |
| 30 | Example | 0.7544 | 0.060 | 0.090 | 0.050 | 0.000 | 0.040 | 0.005 | 0.0006 | Amorphous phase | Present | 224 | 164 | ○ | 64 | 339 |
| 31 | Comparative Example | 0.7444 | 0.060 | 0.090 | 0.050 | 0.000 | 0.050 | 0.005 | 0.0006 | Amorphous phase | Present | 356 | 160 | Δ | 63 | 326 |
| 1 | Example | 0.7944 | 0.060 | 0.090 | 0.050 | 0.000 | 0.000 | 0.005 | 0.0006 | Amorphous phase | Present | 177 | 171 | ○ | 64 | 515 |
| 32 | Example | 0.7844 | 0.060 | 0.090 | 0.050 | 0.010 | 0.000 | 0.005 | 0.0006 | Amorphous phase | Present | 186 | 169 | ◎ | 64 | 574 |
| 33 | Example | 0.7744 | 0.060 | 0.090 | 0.050 | 0.020 | 0.000 | 0.005 | 0.0006 | Amorphous phase | Present | 204 | 167 | ◎ | 65 | 620 |
| 34 | Example | 0.7644 | 0.060 | 0.090 | 0.050 | 0.030 | 0.000 | 0.005 | 0.0006 | Amorphous phase | Present | 220 | 164 | ◎ | 65 | 650 |
| 35 | Example | 0.7344 | 0.060 | 0.090 | 0.050 | 0.060 | 0.000 | 0.005 | 0.0006 | Amorphous phase | Present | 245 | 160 | ◎ | 64 | 691 |
| 36 | Comparative Example | 0.7244 | 0.060 | 0.090 | 0.050 | 0.070 | 0.000 | 0.005 | 0.0006 | Amorphous phase | Present | 372 | 153 | ◎ | 65 | 728 |

TABLE 1-continued

| | | Soft magnetic alloy powder | | | | | | | | | | Powder properties | | Properties after coating | Dust core | |
|---|---|---|---|---|---|---|---|---|---|---|---|---|---|---|---|---|
| | Comparative | $(Fe_{(1-(a+b+c+d+e+f+g))}M_aB_bP_cSi_dC_eS_fTi_g)$ | | | | | | | | | | Coercivity | Saturation magnetization | Resistivity | Relative | Withstand |
| Experiment No. | Example/ Example | Fe | Nb a | B b | P c | Si d | C e | S f | Ti g | XRD | Fe-based nanocrystal | Hc (A/m) | σs (A · m²/kg) | ρ (Ω · cm) | density (%) | voltage (V/mm) |
| 37 | Comparative Example | 0.8000 | 0.060 | 0.090 | 0.050 | 0.000 | 0.000 | 0.000 | 0.0000 | Amorphous phase | Present | 176 | 172 | ○ | 51 | 461 |
| 38 | Example | 0.7980 | 0.060 | 0.090 | 0.050 | 0.000 | 0.000 | 0.002 | 0.0000 | Amorphous phase | Present | 176 | 172 | ○ | 61 | 503 |
| 39 | Example | 0.7950 | 0.060 | 0.090 | 0.050 | 0.000 | 0.000 | 0.005 | 0.0000 | Amorphous phase | Present | 225 | 172 | ○ | 62 | 508 |
| 40 | Example | 0.7900 | 0.060 | 0.090 | 0.050 | 0.000 | 0.000 | 0.010 | 0.0000 | Amorphous phase | Present | 274 | 173 | ○ | 63 | 517 |
| 41 | Comparative Example | 0.7850 | 0.060 | 0.090 | 0.050 | 0.000 | 0.000 | 0.015 | 0.0000 | Amorphous phase | Present | 352 | 173 | ○ | 64 | 522 |
| 42 | Example | 0.7998 | 0.060 | 0.090 | 0.050 | 0.000 | 0.000 | 0.000 | 0.0002 | Amorphous phase | Present | 176 | 170 | ○ | 60 | 500 |
| 43 | Example | 0.7994 | 0.060 | 0.090 | 0.050 | 0.000 | 0.000 | 0.000 | 0.0006 | Amorphous phase | Present | 185 | 169 | ○ | 61 | 503 |
| 44 | Example | 0.7990 | 0.060 | 0.090 | 0.050 | 0.000 | 0.000 | 0.000 | 0.0010 | Amorphous phase | Present | 233 | 168 | ○ | 62 | 509 |
| 45 | Comparative Example | 0.7985 | 0.060 | 0.090 | 0.050 | 0.000 | 0.000 | 0.000 | 0.0015 | Crystal phase | Absent | 15250 | 165 | ○ | 63 | 511 |
| 46 | Example | 0.7978 | 0.060 | 0.090 | 0.050 | 0.000 | 0.000 | 0.002 | 0.0002 | Amorphous phase | Present | 181 | 171 | ○ | 62 | 504 |
| 47 | Example | 0.7944 | 0.060 | 0.090 | 0.050 | 0.000 | 0.000 | 0.005 | 0.0006 | Amorphous phase | Present | 177 | 171 | ○ | 64 | 515 |
| 48 | Example | 0.7890 | 0.060 | 0.090 | 0.050 | 0.000 | 0.000 | 0.010 | 0.0010 | Amorphous phase | Present | 234 | 171 | ○ | 66 | 523 |
| 49 | Comparative Example | 0.7835 | 0.060 | 0.090 | 0.050 | 0.000 | 0.000 | 0.015 | 0.0015 | Crystal phase | Absent | 25321 | 167 | ○ | 69 | 537 |
| 50 | Example | 0.7974 | 0.060 | 0.090 | 0.050 | 0.000 | 0.000 | 0.002 | 0.0006 | Amorphous phase | Present | 188 | 172 | ○ | 62 | 505 |
| 51 | Example | 0.7970 | 0.060 | 0.090 | 0.050 | 0.000 | 0.000 | 0.002 | 0.0010 | Amorphous phase | Present | 239 | 172 | ○ | 63 | 512 |
| 52 | Comparative Example | 0.7965 | 0.060 | 0.090 | 0.050 | 0.000 | 0.000 | 0.002 | 0.0010 | Crystal phase | Absent | 17798 | 170 | ○ | 64 | 512 |
| 53 | Example | 0.7948 | 0.060 | 0.090 | 0.050 | 0.000 | 0.000 | 0.005 | 0.0002 | Amorphous phase | Present | 230 | 172 | ○ | 63 | 509 |
| 54 | Example | 0.7940 | 0.060 | 0.090 | 0.050 | 0.000 | 0.000 | 0.005 | 0.0010 | Amorphous phase | Present | 273 | 172 | ○ | 65 | 521 |
| 55 | Comparative Example | 0.7935 | 0.060 | 0.090 | 0.050 | 0.000 | 0.000 | 0.005 | 0.0015 | Crystal phase | Absent | 20722 | 170 | ○ | 67 | 530 |
| 56 | Example | 0.7898 | 0.060 | 0.090 | 0.050 | 0.000 | 0.000 | 0.010 | 0.0002 | Amorphous phase | Present | 275 | 171 | ○ | 65 | 523 |
| 57 | Example | 0.7890 | 0.060 | 0.090 | 0.050 | 0.000 | 0.000 | 0.010 | 0.0010 | Amorphous phase | Present | 284 | 170 | ○ | 67 | 529 |

TABLE 1-continued

| | | Soft magnetic alloy powder | | | | | | | | | | Powder properties | | Properties after coating | Dust core | |
|---|---|---|---|---|---|---|---|---|---|---|---|---|---|---|---|---|
| | Comparative | $(Fe_{(1-(a+b+c+d+e+f+g))}M_aB_bP_cSi_dC_eS_fTi_g)$ | | | | | | | | | | Coercivity | Saturation magnetization | Resistivity | Relative | Withstand |
| Experiment No. | Example/ Example | Fe | Nb a | B b | P c | Si d | C e | S f | Ti g | XRD | Fe-based nanocrystal | Hc (A/m) | σs (A · m²/kg) | ρ (Ω · cm) | density (%) | voltage (V/mm) |
| 58 | Comparative Example | 0.7885 | 0.060 | 0.090 | 0.050 | 0.000 | 0.000 | 0.010 | 0.0015 | Crystal phase | Absent | 23955 | 169 | ○ | 68 | 533 |
| 59 | Example | 0.7244 | 0.080 | 0.120 | 0.070 | 0.000 | 0.000 | 0.005 | 0.0006 | Amorphous phase | Present | 270 | 154 | ○ | 64 | 499 |
| 1 | Example | 0.7944 | 0.060 | 0.090 | 0.050 | 0.000 | 0.000 | 0.005 | 0.0006 | Amorphous phase | Present | 177 | 171 | ○ | 64 | 578 |
| 60 | Example | 0.8744 | 0.040 | 0.030 | 0.050 | 0.000 | 0.000 | 0.005 | 0.0006 | Amorphous phase | Present | 245 | 185 | ○ | 64 | 495 |
| 61 | Example | 0.8944 | 0.030 | 0.029 | 0.041 | 0.000 | 0.000 | 0.005 | 0.0006 | Amorphous phase | Present | 211 | 189 | ○ | 63 | 480 |
| 62 | Example | 0.8178 | 0.060 | 0.090 | 0.010 | 0.010 | 0.010 | 0.002 | 0.0002 | Amorphous phase | Present | 236 | 177 | ○ | 64 | 562 |
| 63 | Example | 0.7974 | 0.060 | 0.090 | 0.010 | 0.020 | 0.020 | 0.002 | 0.0006 | Amorphous phase | Present | 256 | 171 | ○ | 65 | 571 |
| 64 | Example | 0.7948 | 0.060 | 0.090 | 0.010 | 0.020 | 0.020 | 0.005 | 0.0002 | Amorphous phase | Present | 235 | 171 | ○ | 65 | 570 |
| 65 | Example | 0.7944 | 0.060 | 0.090 | 0.030 | 0.010 | 0.010 | 0.005 | 0.0006 | Amorphous phase | Present | 204 | 168 | ○ | 64 | 577 |
| 66 | Example | 0.7748 | 0.060 | 0.090 | 0.030 | 0.020 | 0.020 | 0.005 | 0.0002 | Amorphous phase | Present | 231 | 161 | ○ | 64 | 592 |
| 67 | Example | 0.7774 | 0.060 | 0.090 | 0.030 | 0.020 | 0.020 | 0.002 | 0.0006 | Amorphous phase | Present | 212 | 160 | ○ | 64 | 593 |
| 68 | Example | 0.7744 | 0.060 | 0.090 | 0.050 | 0.010 | 0.010 | 0.005 | 0.0006 | Amorphous phase | Present | 195 | 160 | ○ | 65 | 596 |
| 69 | Comparative Example | 0.7544 | 0.060 | 0.090 | 0.050 | 0.020 | 0.020 | 0.005 | 0.0006 | Amorphous phase | Present | 216 | 155 | ○ | 63 | 603 |

From Table 1, it was confirmed that in the case where the amount of each component is in the above range and the properties of powders and dust cores are good when Fe-based nanocrystals are present.

In contrast, it was confirmed that in the case where the amount of each component is out of the range described above, or Fe-based nanocrystals are absent, the magnetic properties of powders are poor. It was also confirmed that in the case where both of S and Ti are not contained, the density of the dust core is low.

Experimental Samples 70 to 96

A soft magnetic alloy powder was made in the same manner as in Experimental Samples 1, 4 and 8, except that "M" in the composition formula of the sample in Experimental Samples 1, 4 and 8 was changed to the elements shown in Table 2, and evaluated in the same manner as in Experimental Samples 1, 4 and 8. Further, Using the obtained powder, a dust core was made in the same manner as in Experimental Samples 1, 4 and 8, and evaluated in the same manner as in Experimental Samples 1, 4 and 8. The results are shown in Table 2.

TABLE 2

| | | Soft magnetic alloy powder | | | | | | |
|---|---|---|---|---|---|---|---|---|
| | | | | Powder properties | | Properties after coating | Dust core | |
| Experiment No. | Comparative Example/ Example | $Fe_{(1-a+b+c+d+e+f+g)}M_aB_bP_cSi_dC_eS_fTi_g$ ($\alpha = \beta = 0$) Type | a | Coercivity Hc (A/m) | Saturation magnetization σs (A · m²/kg) | Resistivity ρ at 0.6 t/cm² (Ω · cm) | Relative density (%) | Withstand voltage (V/mm) |
| 4 | Example | Nb | 0.040 | 211 | 178 | ○ | 64 | 458 |
| 70 | Example | Hf | 0.040 | 203 | 177 | ○ | 63 | 432 |
| 71 | Example | Zr | 0.040 | 203 | 176 | ○ | 63 | 420 |
| 72 | Example | Ta | 0.040 | 210 | 176 | ○ | 64 | 417 |
| 73 | Example | Mo | 0.040 | 211 | 175 | ○ | 63 | 421 |
| 74 | Example | W | 0.040 | 218 | 174 | ○ | 64 | 443 |
| 75 | Example | V | 0.040 | 219 | 176 | ○ | 63 | 446 |
| 76 | Example | $Nb_{0.5}Hf_{0.5}$ | 0.040 | 228 | 174 | ○ | 64 | 452 |
| 77 | Example | $Zr_{0.5}Ta_{0.5}$ | 0.040 | 202 | 174 | ○ | 64 | 429 |
| 78 | Example | $Nb_{0.4}Hf_{0.3}Zr_{0.3}$ | 0.040 | 228 | 175 | ○ | 64 | 431 |
| 1 | Example | Nb | 0.060 | 177 | 171 | ○ | 64 | 515 |
| 79 | Example | Hf | 0.060 | 169 | 170 | ○ | 64 | 481 |
| 80 | Example | Zr | 0.060 | 176 | 170 | ○ | 63 | 473 |
| 81 | Example | Ta | 0.060 | 168 | 169 | ○ | 65 | 466 |
| 82 | Example | Mo | 0.060 | 185 | 169 | ○ | 64 | 483 |
| 83 | Example | W | 0.060 | 177 | 171 | ○ | 64 | 455 |
| 84 | Example | V | 0.060 | 185 | 169 | ○ | 64 | 478 |
| 85 | Example | $Nb_{0.5}Hf_{0.5}$ | 0.060 | 167 | 169 | ○ | 64 | 480 |
| 86 | Example | $Zr_{0.5}Ta_{0.5}$ | 0.060 | 177 | 167 | ○ | 65 | 491 |
| 87 | Example | $Nb_{0.4}Hf_{0.3}Zr_{0.3}$ | 0.060 | 193 | 167 | ○ | 64 | 488 |
| 8 | Example | Nb | 0.120 | 252 | 158 | ○ | 64 | 539 |
| 88 | Example | Hf | 0.120 | 261 | 157 | ○ | 64 | 506 |
| 89 | Example | Zr | 0.120 | 261 | 157 | ○ | 64 | 498 |
| 90 | Example | Ta | 0.120 | 270 | 156 | ○ | 65 | 481 |
| 91 | Example | Mo | 0.120 | 260 | 155 | ○ | 65 | 490 |
| 92 | Example | W | 0.120 | 270 | 155 | ○ | 64 | 481 |
| 93 | Example | V | 0.120 | 278 | 157 | ○ | 64 | 486 |
| 94 | Example | $Nb_{0.5}Hf_{0.5}$ | 0.120 | 269 | 157 | ○ | 64 | 496 |
| 95 | Example | $Zr_{0.5}Ta_{0.5}$ | 0.120 | 261 | 156 | ○ | 65 | 490 |
| 96 | Example | $Nb_{0.4}Hf_{0.3}Zr_{0.3}$ | 0.120 | 287 | 155 | ○ | 65 | 488 |

*b, c, d, e, f and g are the same as those in Example 1.

From Table 2, it was confirmed that the properties of the powders and the dust cores are good regardless of the composition and the amount of the element M.

Experimental Samples 97 to 150

A soft magnetic alloy powder was made in the same manner as in Experimental Sample 1, except that the elements "X1" and "X2" and the amounts of "X1" and "X2" in the composition formula in Experimental Sample 1 were changed to the elements and the amount shown in Table 3, and evaluated in the same manner as in Experimental Sample 1. Using the obtained powder, a dust core was made as in Experimental Sample 1, and evaluated in the same manner as in Experimental Sample 1. The results are shown in Table 3.

TABLE 3

| Experiment No. | Comparative Example/ Example | Soft magnetic alloy powder: $Fe_{(1-(\alpha+\beta))}X1_{\alpha}X2_{\beta}$ X1 Type | X1 $\alpha\{1-(a+b+c+d+e+f+g)\}$ | X2 Type | X2 $\beta\{1-(a+b+c+d+e+f+g)\}$ | Poster properties: Coercivity Hc (A/m) | Saturation magnetization σs ($A \cdot m^2/kg$) | Properties after coating: Relativity ρ at $0.6t/cm^2$ (Ω cm) | Dust core Properties: Relative density (%) | Withstand voltage (V/mm) |
|---|---|---|---|---|---|---|---|---|---|---|
| 1 | Example | — | 0.000 | — | 0.000 | 177 | 171 | ○ | 64 | 515 |
| 97 | Example | Co | 0.010 | — | 0.000 | 211 | 171 | ○ | 64 | 494 |
| 98 | Example | Co | 0.100 | — | 0.000 | 237 | 171 | ○ | 64 | 498 |
| 99 | Example | Co | 0.400 | — | 0.000 | 286 | 174 | ○ | 63 | 501 |
| 100 | Example | Ni | 0.010 | — | 0.000 | 177 | 174 | ○ | 64 | 499 |
| 101 | Example | Ni | 0.100 | — | 0.000 | 170 | 167 | ○ | 64 | 491 |
| 102 | Example | Ni | 0.400 | — | 0.000 | 161 | 164 | ○ | 63 | 483 |
| 103 | Example | — | 0.000 | Al | 0.001 | 151 | 169 | ○ | 64 | 511 |
| 104 | Example | — | 0.000 | Al | 0.000 | 176 | 170 | ◎ | 64 | 552 |
| 105 | Example | — | 0.000 | Al | 0.010 | 169 | 169 | ◎ | 64 | 578 |
| 106 | Example | — | 0.000 | Al | 0.030 | 176 | 167 | ◎ | 64 | 601 |
| 107 | Example | — | 0.000 | Zn | 0.001 | 184 | 167 | ○ | 64 | 502 |
| 108 | Example | — | 0.000 | Zn | 0.005 | 185 | 167 | ○ | 64 | 515 |
| 109 | Example | — | 0.000 | Zn | 0.010 | 177 | 170 | ◎ | 64 | 559 |
| 110 | Example | — | 0.000 | Zn | 0.030 | 186 | 170 | ◎ | 63 | 587 |
| 111 | Example | — | 0.000 | Sn | 0.001 | 185 | 169 | ○ | 64 | 520 |
| 112 | Example | — | 0.000 | Sn | 0.005 | 177 | 169 | ◎ | 64 | 563 |
| 113 | Example | — | 0.000 | Sn | 0.010 | 178 | 167 | ◎ | 64 | 585 |
| 114 | Example | — | 0.000 | Sn | 0.030 | 194 | 169 | ◎ | 63 | 592 |
| 115 | Example | — | 0.000 | Cu | 0.001 | 161 | 169 | ◎ | 64 | 559 |
| 116 | Example | — | 0.000 | Cu | 0.005 | 162 | 170 | ◎ | 64 | 578 |
| 117 | Example | — | 0.000 | Cu | 0.010 | 152 | 171 | ◎ | 64 | 591 |
| 118 | Example | — | 0.000 | Cu | 0.030 | 160 | 175 | ◎ | 63 | 614 |
| 119 | Example | — | 0.000 | Cr | 0.001 | 186 | 174 | ◎ | 64 | 566 |
| 120 | Example | — | 0.000 | Cr | 0.005 | 170 | 173 | ◎ | 64 | 589 |
| 121 | Example | — | 0.000 | Cr | 0.010 | 169 | 170 | ◎ | 64 | 595 |
| 122 | Example | — | 0.000 | Cr | 0.030 | 185 | 16 | ◎ | 64 | 603 |
| 123 | Example | — | 0.000 | Bi | 0.001 | 177 | 165 | ◎ | 65 | 555 |
| 124 | Example | — | 0.000 | Bi | 0.005 | 169 | 168 | ◎ | 64 | 571 |
| 125 | Example | — | 0.000 | Bi | 0.010 | 168 | 163 | ◎ | 64 | 590 |
| 126 | Example | — | 0.000 | Bi | 0.030 | 193 | 165 | ◎ | 63 | 611 |
| 127 | Example | — | 0.000 | La | 0.001 | 186 | 163 | ◎ | 64 | 510 |
| 128 | Example | — | 0.000 | La | 0.005 | 193 | 168 | ◎ | 64 | 561 |
| 129 | Example | — | 0.000 | La | 0.010 | 203 | 172 | ◎ | 63 | 571 |
| 130 | Example | — | 0.000 | La | 0.030 | 211 | 164 | ◎ | 64 | 589 |
| 131 | Example | — | 0.000 | Y | 0.001 | 195 | 168 | ◎ | 64 | 553 |
| 132 | Example | — | 0.000 | Y | 0.005 | 181 | 170 | ◎ | 64 | 569 |
| 133 | Example | — | 0.000 | Y | 0.010 | 187 | 167 | ◎ | 63 | 581 |

TABLE 3-continued

| | | Soft magnetic alloy powder | | | | | | | | |
|---|---|---|---|---|---|---|---|---|---|---|
| | | | | | | Poster properties | | Properties after coating | Dust core Properties | |
| | Comparative | $Fe_{(1-(\alpha+\beta))}X1_{\alpha}X2_{\beta}$ | | | | Coercivity | Saturation magnetization | Relativity ρ | Relative | Withstand |
| Experiment | Example/ | X1 | | X2 | | Hc | σs | at 0.6t/cm$^2$ | density | voltage |
| No. | Example | Type | α{1−(a+b+c+d+e+f+g)} | Type | β{1−(a+b+c+d+e+f+g)} | (A/m) | (A · m$^2$/kg) | (Ω cm) | (%) | (V/mm) |
| 134 | Example | — | 0.000 | Y | 0.030 | 187 | 165 | ◎ | 64 | 594 |
| 135 | Example | Co | 0.100 | Al | 0.050 | 203 | 171 | ◎ | 64 | 560 |
| 136 | Example | Co | 0.100 | Zn | 0.050 | 219 | 168 | ◎ | 64 | 559 |
| 137 | Example | Co | 0.100 | Sn | 0.050 | 228 | 173 | ◎ | 63 | 561 |
| 138 | Example | Co | 0.100 | Cu | 0.050 | 193 | 170 | ◎ | 64 | 563 |
| 139 | Example | Co | 0.100 | Cr | 0.050 | 203 | 171 | ◎ | 64 | 558 |
| 140 | Example | Co | 0.100 | Bi | 0.050 | 214 | 168 | ◎ | 62 | 559 |
| 141 | Example | Co | 0.100 | La | 0.050 | 220 | 169 | ◎ | 64 | 553 |
| 142 | Example | Co | 0.100 | Y | 0.050 | 229 | 170 | ◎ | 64 | 560 |
| 143 | Example | Ni | 0.100 | Al | 0.050 | 168 | 168 | ◎ | 62 | 561 |
| 144 | Example | Ni | 0.100 | Zn | 0.050 | 169 | 165 | ◎ | 62 | 560 |
| 145 | Example | Ni | 0.100 | Sn | 0.050 | 161 | 168 | ◎ | 64 | 559 |
| 146 | Example | Ni | 0.100 | Cu | 0.050 | 170 | 167 | ◎ | 63 | 556 |
| 147 | Example | Ni | 0.100 | Cr | 0.050 | 162 | 165 | ◎ | 64 | 551 |
| 148 | Example | Ni | 0.100 | Bi | 0.050 | 169 | 165 | ◎ | 63 | 562 |
| 149 | Example | Ni | 0.100 | La | 0.050 | 152 | 164 | ◎ | 64 | 559 |
| 150 | Example | Ni | 0.100 | Y | 0.050 | 186 | 165 | ◎ | 63 | 558 |

*M, a, b, c, d, e, f and g are the same as those in Example 1.

From Table 3, it was confirmed that the properties of the powder and the dust core are good regardless of the composition and the amount of elements X1 and X2.

Experimental Samples 151 to 171

A soft magnetic alloy powder was made in the same manner as in Experimental Sample 1, except that the composition of the coating material was changed to that shown in Table 4 and the thickness of the coating portion formed from coating material was changed to that shown in Table 4, and evaluated in the same manner as in Experimental Sample 1. Using the obtained powder, a dust core was made in the same manner as in Experimental Sample 1 and evaluated in the same manner as in Experimental Sample 1. The results are shown in Table 4. Note that, no coating portion was formed on the sample in Experimental Sample 151.

In the present Examples, in the powder glass $Bi_2O_3$—ZnO—$B_2O_3$—$SiO_2$ as a bismuthate glass, 80 wt % of $Bi_2O_3$, 10 wt % of ZnO, 5 wt % of $B_2O_3$, and 5 wt % of $SiO_2$ were contained. A bismuthate glass having another composition was subjected to the similar experiment, and it was confirmed that the same results as the ones described below were obtained.

In the present Examples, in the powder glass BaO—ZnO—$B_2O_3$—$SiO_2$—$Al_2O_3$ as a borosilicate glass, 8 wt % of BaO, 23 wt % of ZnO, 19 wt % of $B_2O_3$, 16 wt % of $SiO_2$, 6 wt % of $Al_2O_3$, and the remaining part being accessory components were contained. A borosilicate glass having another composition was subjected to the similar experiment, and it was confirmed that the same results as the ones described below were obtained.

TABLE 4

| | | Soft magnetic alloy powder $(Fe_{(1-(a+b+c+d+e+f+g))}M_aB_bP_cSi_dC_eS_fTi_g)$ | | | | |
|---|---|---|---|---|---|---|
| | | | | Properties after coating | Dust core Properties | |
| | Comparative | Coating region | | Resistivity ρ | Relative | Withstand |
| Experiment No. | Example/ Example | Coating material | Thickness (nm) | at 0.6 t/cm$^2$ (Ω · cm) | density (%) | voltage (V/mm) |
| 151 | Comparative Example | — | — | X | 69 | 79 |
| 152 | Example | $P_2O_5$—ZnO—$R_2O$—$Al_2O_3$ | 1 | Δ | 69 | 178 |
| 153 | Example | $P_2O_5$—ZnO—$R_2O$—$Al_2O_3$ | 5 | Δ | 68 | 278 |
| 154 | Example | $P_2O_5$—ZnO—$R_2O$—$Al_2O_3$ | 20 | ○ | 66 | 382 |
| 1 | Example | $P_2O_5$—ZnO—$R_2O$—$Al_2O_3$ | 50 | ○ | 64 | 515 |
| 155 | Example | $P_2O_5$—ZnO—$R_2O$—$Al_2O_3$ | 100 | ○ | 63 | 571 |
| 156 | Example | $P_2O_5$—ZnO—$R_2O$—$Al_2O_3$ | 150 | ○ | 62 | 621 |
| 157 | Example | $P_2O_5$—ZnO—$R_2O$—$Al_2O_3$ | 200 | ◎ | 61 | 730 |
| 158 | Example | $Bi_2O_3$—ZnO—$B_2O_3$—$SiO_2$ | 1 | Δ | 69 | 182 |
| 159 | Example | $Bi_2O_3$—ZnO—$B_2O_3$—$SiO_2$ | 5 | Δ | 69 | 270 |
| 160 | Example | $Bi_2O_3$—ZnO—$B_2O_3$—$SiO_2$ | 20 | ○ | 68 | 365 |
| 161 | Example | $Bi_2O_3$—ZnO—$B_2O_3$—$SiO_2$ | 50 | ○ | 65 | 489 |
| 162 | Example | $Bi_2O_3$—ZnO—$B_2O_3$—$SiO_2$ | 100 | ○ | 64 | 523 |
| 163 | Example | $Bi_2O_3$—ZnO—$B_2O_3$—$SiO_2$ | 150 | ○ | 62 | 567 |
| 164 | Example | $Bi_2O_3$—ZnO—$B_2O_3$—$SiO_2$ | 200 | ◎ | 61 | 633 |
| 165 | Example | BaO—ZnO—$B_2O_3$—$SiO_2$—$Al_2O_3$ | 1 | Δ | 68 | 175 |
| 166 | Example | BaO—ZnO—$B_2O_3$—$SiO_2$—$Al_2O_3$ | 5 | Δ | 67 | 265 |
| 167 | Example | BaO—ZnO—$B_2O_3$—$SiO_2$—$Al_2O_3$ | 20 | ○ | 66 | 373 |
| 168 | Example | BaO—ZnO—$B_2O_3$—$SiO_2$—$Al_2O_3$ | 50 | ○ | 65 | 480 |
| 169 | Example | BaO—ZnO—$B_2O_3$—$SiO_2$—$Al_2O_3$ | 100 | ○ | 64 | 541 |
| 170 | Example | BaO—ZnO—$B_2O_3$—$SiO_2$—$Al_2O_3$ | 150 | ○ | 64 | 571 |
| 171 | Example | BaO—ZnO—$B_2O_3$—$SiO_2$—$Al_2O_3$ | 200 | ◎ | 62 | 672 |

*M, α, β, a, b, c, d, e, f and g are the same as those in Example 1.

From Table 4, it was confirmed that the resistivity of the powder and the withstand voltage of the dust core improve as the thickness of the coating portion increases. It was also confirmed that the resistivity of the powder and the withstand voltage of the dust core are good and the density of the dust core is high regardless of the composition of the coating material.

Experimental Samples 172 to 185

A soft magnetic alloy powder was made in the same manner as in Experimental Sample 1, except that the molten metal temperature during atomization and the heat treatment conditions of the obtained powder by atomization of the sample in Experimental Sample 1 were changed to the conditions shown in Table 5, and evaluated in the same manner as in Experimental Sample 1. Using the obtained powder, a dust core was made in the same manner as in Experimental Sample 1 and evaluated in the same manner as in Experimental Sample 1. The results are shown in Table 5.

From Table 5, it was confirmed that the powder having a nano-heterostructure with an initial fine crystals, or the powder having Fe-based nanocrystals after heat treatment, achieves high resistivity of the powder, good withstand voltage of a dust core, and high density of the dust core, regardless of the average grain size of initial fine crystals or the average gran size of Fe-based nanocrystals.

DESCRIPTION OF SYMBOLS

1: COATED PARTICLE, 10: COATING PORTION, 2: SOFT MAGNETIC ALLOY PARTICLE

What is claimed is:

1. A soft magnetic alloy powder comprising a plurality of soft magnetic alloy particles of a soft magnetic alloy represented by a composition formula $(Fe_{(1-(\alpha+\beta))}X1_{\alpha}X2_{\beta})_{(1-(a+b+c++e+f+g))}M_aB_bP_cSi_dC_eS_fTi_g$, wherein X1 represents at least one selected from the group consisting of Co and Ni;

TABLE 5

| | | Soft magnetic alloy powder $Fe_{(1-(a+b+c+d+e+f+g))}M_aB_bP_cSi_dC_eS_fTi_g$ | | | | | | | | | | |
|---|---|---|---|---|---|---|---|---|---|---|---|---|
| | | | | | | | Powder properties | | | Properties after coating | Dust core | |
| Experiment No. | Comparative Example/ Example | Metal temperature (° C.) | Average grain size of intial fine crystal (nm) | Heat treatment temperature (° C.) | Heat treatment time (h.) | Average grain size of Fe-based nanocrystal alloy (nm) | XRD | Coercivity Hc (A/m) | Saturation magnetization σs (A · m²/kg) | Resistivity ρ (Ω · cm) | Relative density (%) | Withstand voltage (V/mm) |
| 172 | Example | 1200 | Absence of initial fine crystal | 600 | 1 | 10 | Amorphous phase | 184 | 163 | ○ | 65 | 475 |
| 173 | Comparative Example | 1200 | Absence of initial fine crystal | None | None | None | Amorphous phase | 153 | 142 | ○ | 65 | 342 |
| 174 | Example | 1225 | 0.1 | None | None | 1 | Amorphous phase | 182 | 160 | ○ | 64 | 459 |
| 175 | Example | 1225 | 0.1 | 450 | 1 | 3 | Amorphous phase | 192 | 164 | ○ | 64 | 470 |
| 176 | Example | 1250 | 0.3 | None | None | 2 | Amorphous phase | 158 | 165 | ○ | 64 | 476 |
| 177 | Example | 1250 | 0.3 | 500 | 1 | 5 | Amorphous phase | 167 | 165 | ○ | 64 | 485 |
| 178 | Example | 1250 | 0.3 | 550 | 1 | 10 | Amorphous phase | 175 | 167 | ○ | 64 | 504 |
| 179 | Example | 1250 | 0.3 | 575 | 1 | 13 | Amorphous phase | 150 | 170 | ○ | 64 | 508 |
| 1 | Example | 1250 | 0.3 | 600 | 1 | 10 | Amorphous phase | 177 | 171 | ○ | 64 | 515 |
| 180 | Example | 1275 | 10 | None | None | 10 | Amorphous phase | 162 | 170 | ○ | 64 | 503 |
| 181 | Example | 1275 | 10 | 600 | 1 | 12 | Amorphous phase | 167 | 171 | ○ | 64 | 509 |
| 182 | Example | 1275 | 10 | 650 | 1 | 30 | Amorphous phase | 175 | 170 | ○ | 64 | 504 |
| 183 | Example | 1300 | 15 | None | None | 11 | Amorphous phase | 185 | 171 | ○ | 63 | 510 |
| 184 | Example | 1300 | 15 | 600 | 1 | 17 | Amorphous phase | 192 | 168 | ○ | 63 | 499 |
| 185 | Example | 1300 | 15 | 650 | 10 | 50 | Amorphous phase | 292 | 161 | ○ | 63 | 485 |

*M, α, β, a, b, c, d, e, f and g are the same as those in Example 1.

X2 represents at least one selected from the group consisting of Al, Mn, Ag, Zn, Sn, As, Sb, Cu, Cr, Bi, N, O and rare earth elements;

M represents at least one selected from the group consisting of Nb, Hf, Zr, Ta, Mo, W and V;

a, b, c, d, e, f, g, α and β satisfy the following relations:

$0.020 \leq a \leq 0.14$, $0.020 < b \leq 0.20$, $0 < c \leq 0.15$, $0 \leq d \leq 0.060$, $0 \leq e \leq 0.040$, $0 \leq f \leq 0.010$, $0 \leq g \leq 0.0010$, $\alpha \geq 0$, $\beta \geq 0$, and $0 \leq \alpha + \beta \leq 0.50$, wherein at least one of f and g is more than 0; and wherein the soft magnetic alloy has a nano-heterostructure with initial fine crystals present in an amorphous substance;

the surface of each of the soft magnetic alloy particles is covered with a coating portion; and the coating portion comprises a compound of at least one element selected from the group consisting of P, Si, Bi, and Zn.

2. The soft magnetic alloy powder according to claim 1, wherein the initial fine crystal has an average grain size of 0.3 nm or more and 10 nm or less.

3. A dust core comprising the soft magnetic alloy powder according to claim 1.

4. A magnetic component comprising the dust core according to claim 3.

5. A soft magnetic alloy powder comprising a plurality of soft magnetic alloy particles of a soft magnetic alloy represented by a composition formula $(Fe_{(1-(\alpha+\beta))}X1_{\alpha}X2_{\beta})_{(1-(a+b+c++e+f+g))}M_aB_bP_cSi_dC_eS_fTi_g$, wherein X1 represents at least one selected from the group consisting of Co and Ni;

X2 represents at least one selected from the group consisting of Al, Mn, Ag, Zn, Sn, As, Sb, Cu, Cr, Bi, N, O and rare earth elements;

M represents at least one selected from the group consisting of Nb, Hf, Zr, Ta, Mo, W and V;

a, b, c, d, e, f, g, α and β satisfy the following relations:

$0.020 \leq a \leq 0.14$, $0.020 < b \leq 0.20$, $0 < c \leq 0.15$, $0 \leq d \leq 0.060$, $0 \leq e \leq 0.040$, $0 \leq f \leq 0.010$, $0 \leq g \leq 0.0010$, $\alpha \geq 0$, $\beta \geq 0$, and $0 \leq \alpha + \beta \leq 0.50$, wherein at least one of f and g is more than 0;

the soft magnetic alloy has an Fe-based nanocrystal;

the surface of each of the soft magnetic alloy particles is covered with a coating portion; and the coating portion comprises a compound at least one element selected from the group consisting of P, Si, Bi, and Zn.

6. The soft magnetic alloy powder according to claim 5, wherein the Fe-based nanocrystal has an average grain size of 5 nm or more and 30 nm or less.

7. A dust core comprising the soft magnetic alloy powder according to claim 5.

8. A magnetic component comprising the dust core according to claim 7.

* * * * *